US007972150B1

(12) United States Patent
Lin

(10) Patent No.: US 7,972,150 B1
(45) Date of Patent: Jul. 5, 2011

(54) ALIEN CROSSTALK PREVENTIVE ELECTRICAL SOCKET, ELECTRICAL PLUG AND NETWORK CABLE

(75) Inventor: Yen-Lin Lin, Luchou (TW)

(73) Assignee: Jyh Eng Technology Co., Ltd., Luchou, Taipei Hsien (TW)

( * ) Notice: Subject to any disclaimer, the term of this patent is extended or adjusted under 35 U.S.C. 154(b) by 0 days.

(21) Appl. No.: 12/939,978

(22) Filed: Nov. 4, 2010

(51) Int. Cl.
*H01R 13/627* (2006.01)

(52) U.S. Cl. ..... 439/88; 439/607.03; 439/941

(58) Field of Classification Search ..... 439/354, 439/358, 357, 594, 606, 676, 607.03, 941, 439/88
See application file for complete search history.

(56) References Cited

U.S. PATENT DOCUMENTS 4,146,291 A * 3/1979 Goff et al. ..... 439/90
4,155,613 A * 5/1979 Brandeau ..... 439/90
6,559,649 B2 * 5/2003 Deleu et al. ..... 324/457
7,083,472 B2 * 8/2006 Gordon et al. ..... 439/607.48
7,255,587 B2 * 8/2007 Boeck et al. ..... 439/358
7,578,695 B2 * 8/2009 Boeck et al. ..... 439/463
2006/0030192 A1 * 2/2006 Boeck et al. ..... 439/344
* cited by examiner

*Primary Examiner* — Neil Abrams
*Assistant Examiner* — Phuongchi T Nguyen
(74) *Attorney, Agent, or Firm* — Guice Patents PLLC

(57) ABSTRACT

An alien crosstalk preventive electrical socket, electrical plug and network cable, in which the body, upper back cover, lower back cover and IDC housing of the electrical socket, the insulative jacket, rack and plug body of the electrical plug and the cylindrical outer insulation of the network cable are made of an electrically conductive plastic complex material prepared from a compound of a plastic material and an electrically conductive material, said electrically conductive plastic complex material having high dielectric index and low electrical resistivity characteristics to avoid signal in and signal out and to reducing alien crosstalk, thereby effectively preventing EMI (electromagnetic interference) radiation.

2 Claims, 6 Drawing Sheets
(2 of 6 Drawing Sheet(s) Filed in Color)

ALIEN CROSSTALK PREVENTIVE ELECTRICAL SOCKET, ELECTRICAL PLUG AND NETWORK CABLE

BACKGROUND OF THE INVENTION

1. Field of the Invention

The present invention relates to alien crosstalk prevention technology and more particularly, to the fabrication of an alien crosstalk preventive electrical socket, electrical plug and network cable by means of the application of an electrically conductive plastic complex material prepared from a compound of a plastic material and an electrically conductive material that has high dielectric index and low electrical resistivity characteristics to reduce alien crosstalk.

2. Description of the Related Art

Following fast development wide application of network technology, computers and electronic equipment must be connected to the internet for communication with remote device. When connecting a computer or electronic device to a local area network (LAN), for example, Ethernet network, an electrical network connector consisting of a network socket and a network plug shall be used for data transmission.

A network socket generally comprises a body having a front insertion hole for the insertion of a matching network plug, and an IDC (insulation displacement contact) housing mounted in the body. The IDC housing comprises a plurality of multiple metal contacts extending to the insertion hole for the contact of the respective metal contacts of the inserted network plug for data transmission. The metal contacts are respectively connected to twisted pairs of electrical sires of a network cable. An undesired coupling from one electrical wire to another occurs during signal transmission through the electrical network connector.

In a high-frequency electrical connector, data transmission signal goes in and out of the insulative body, causing electromagnetic interference (EMI). To avoid EMI radiation, a metal shield is commonly used to surround the insulative body. The installation of this metal shield complicates the installation and increases the cost.

SUMMARY OF THE INVENTION

The present invention has been accomplished under the circumstances in view. It is therefore the main object of the present invention to provide an alien crosstalk preventive electrical socket, electrical plug and network cable, which avoids signal in and signal out to reduce alien crosstalk and to effectively prevent EMI (electromagnetic interference) radiation.

To achieve this and other objects of the present invention, an alien crosstalk preventive electrical socket comprises a body having an insertion hole located on a front side thereof for the insertion of a matching electrical plug, an upper back cover and a lower back cover respectively pivotally connected to rear upper side and rear bottom side of the body, an IDC housing accommodated in the body, the IDC housing comprising a plurality of metal contacts positioned in the insertion hole of the body for the contact of matching contacts of an inserted electrical plug for data transmission, and a back cover fastened to the upper back cover and the lower back cover at a back. The body, the upper back cover, the lower back cover and the IDC housing are made of an electrically conductive plastic complex material prepared from a compound of a plastic material and an electrically conductive material, the electrically conductive plastic complex material having high dielectric index and low electrical resistivity characteristics to reduce alien crosstalk.

Crosstalk test of the alien crosstalk preventive electrical socket showed that the crosstalk was greatly reduced, or about 10 db at 100 MHz. One same test of an equivalent conventional electrical socket shows that the electrical socket failed at the high frequency range. Therefore, the invention effectively reduces alien crosstalk.

The same electrically conductive plastic complex material can be used for the fabrication of an alien crosstalk preventive electrical plug and an alien crosstalk preventive network cable

BRIEF DESCRIPTION OF THE DRAWINGS

The patent or application file contains at least one drawing executed in color. Copies of this patent or patent application publication with color drawing(s) will be provided by the Office upon request and payment of the necessary fee.

DETAILED DESCRIPTION OF THE PREFERRED EMBODIMENT

Figure 1:
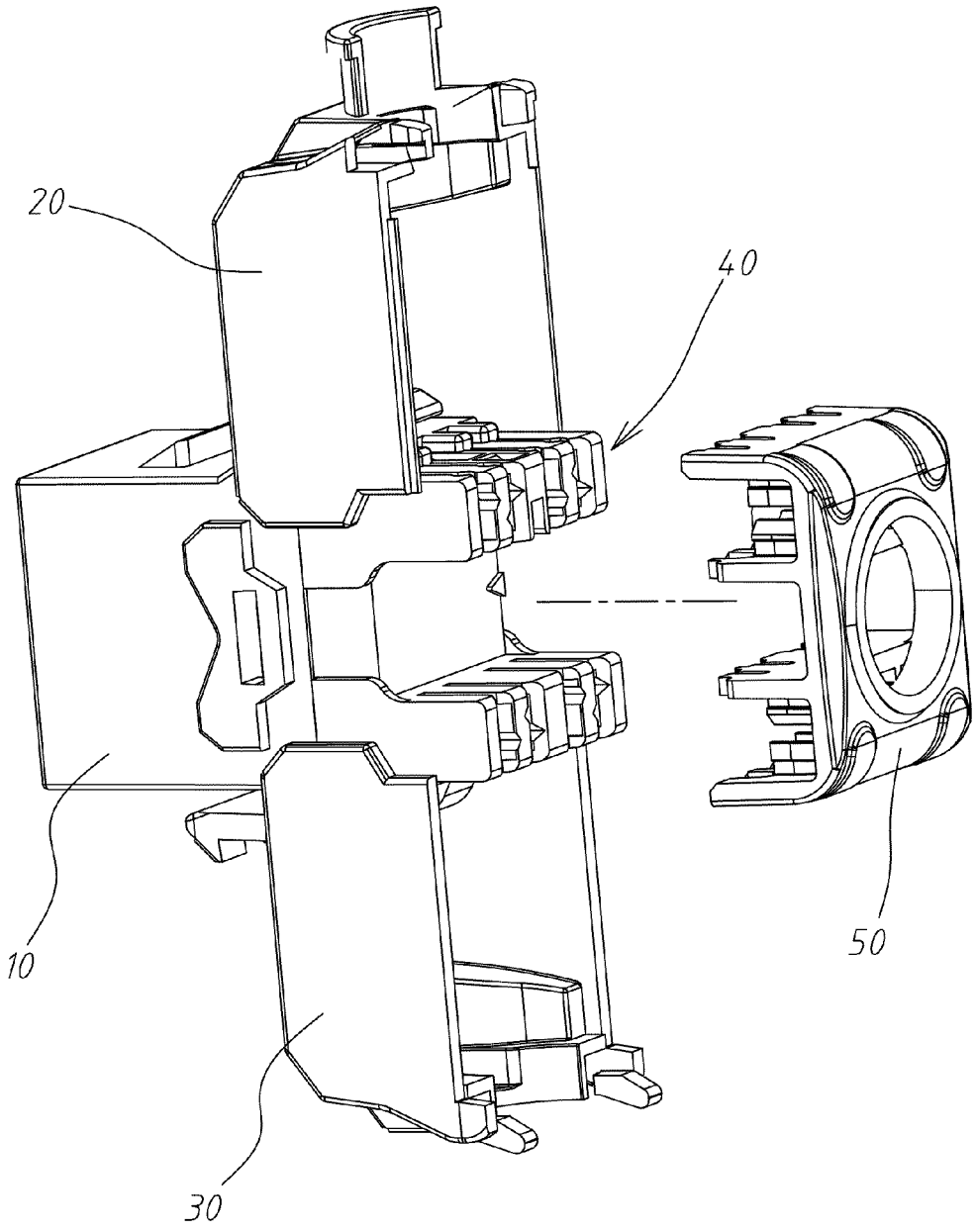
FIG. 1 is an exploded, rear side view of an alien crosstalk preventive electrical socket constructed in accordance with the present invention.
Figure 2:
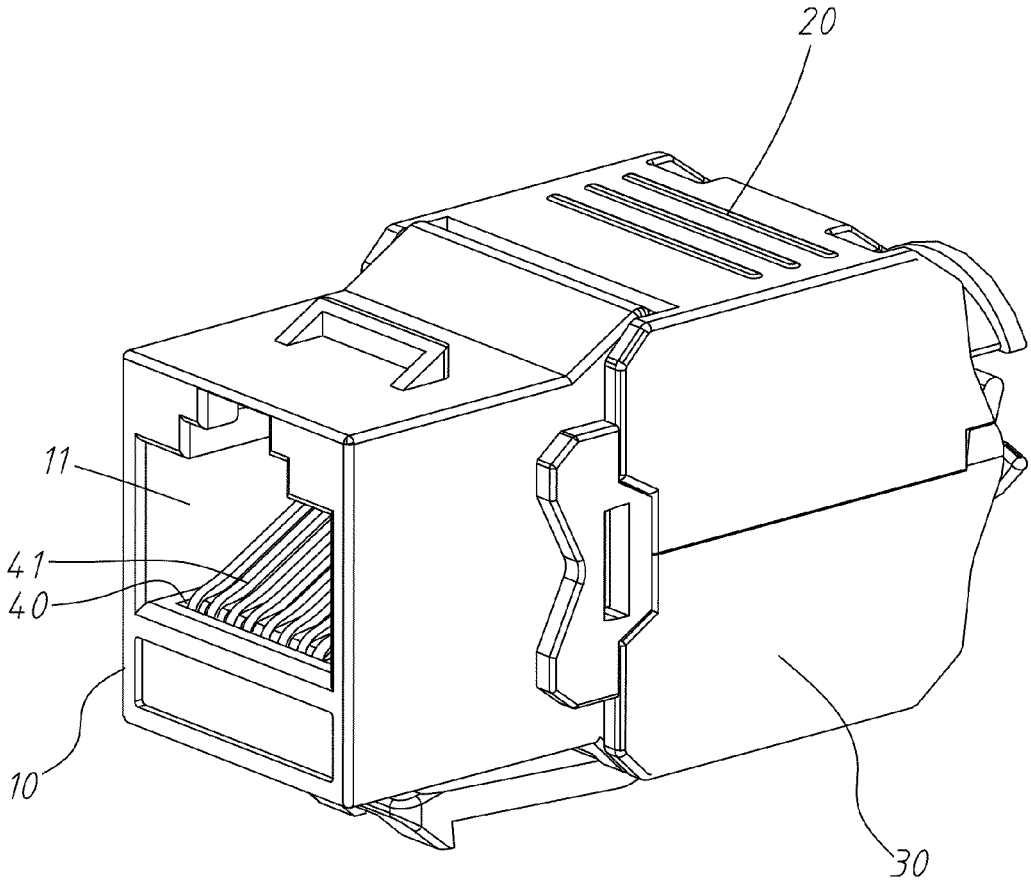
FIG. 2 is an elevational assembly view of the alien crosstalk preventive electrical socket shown in FIG. 1.

FIGS. 1 and 2, an alien crosstalk preventive electrical socket in accordance with the present invention is shown comprising a body 10, a rear upper cover 20, a rear bottom cover 30, an IDC (insulation displacement contact) housing 40 and a back cover 50.

The body 10 has a front insertion hole 11 for the insertion of an external matching electrical plug (not shown). The upper back cover 20 and the lower back cover 30 are respectively pivotally connected to the rear upper side and rear bottom side of the body 10, and can be turned relative to the body 10 between an open position as shown in FIG. 1, or a close position as shown in FIG. 2.

The IDC housing 40 is accommodated in the body 10, the upper back cover 20 and the lower back cover 30. The front side of the IDC housing 40 is positioned in the front insertion hole 11 of the body 10, comprising multiple metal contacts 41 for the contact of the matching contacts of the inserted electrical plug for data transmission. Further, the back cover 50 is fastened to the upper back cover 20 and the lower back cover 30 at the back, so that the upper back cover 20 and the lower back cover 30 can cover the rear side of the IDC housing 40.

By means of assembling the aforesaid component parts, an alien crosstalk preventive electrical socket is provided.

The main feature of the present invention is that the body 10, the upper back cover 20, the lower back cover 30 and the IDC housing 40 are made of an electrically conductive plastic complex material prepared from a compound of a plastic material and an electrically conductive material. The electrically conductive plastic complex material has high dielectric index and low electrical resistivity characteristics, avoiding signal in and signal out and reducing alien crosstalk, and therefore effectively preventing EMI (electromagnetic interference) radiation.

Adding the electrically conductive material in the electrically conductive plastic complex material of the body 10, the upper back cover 20, the lower back cover 30 and the IDC housing 40 does not affect the internal electrical properties of the electrical socket.

Further, when preparing the electrically conductive plastic complex material, the electrically conductive material is added to the plastic material in the form of grains, powder or fibers, and then well mixed, and then processed through an injection fusion process. The electrical resistivity of the electrically conductive plastic complex material is about 10,000~100,000 ohms.

Figure 3:
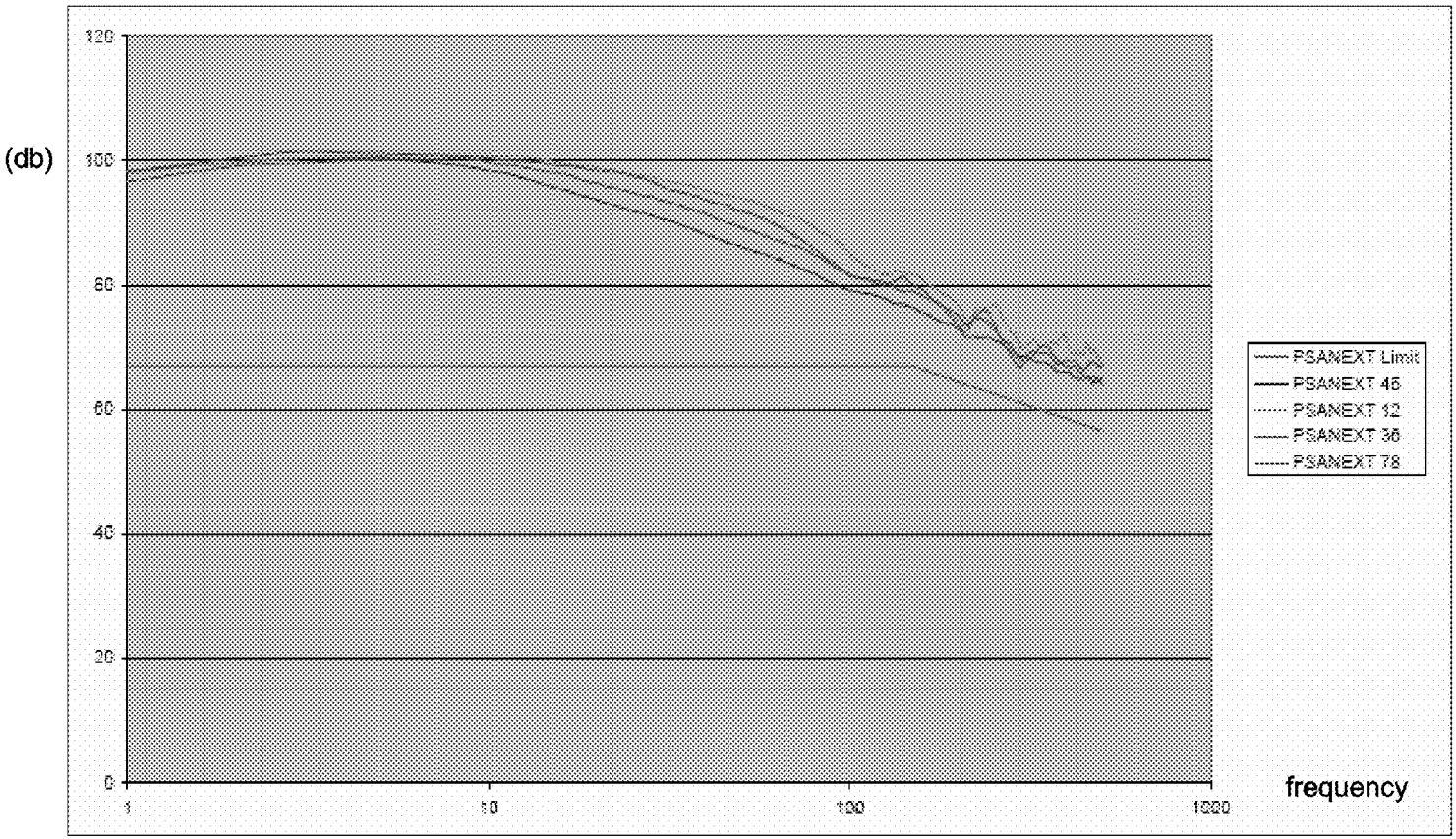
FIG. 3 is a crosstalk curve obtained from the alien crosstalk preventive electrical socket shown in FIG. 2.
Figure 4:
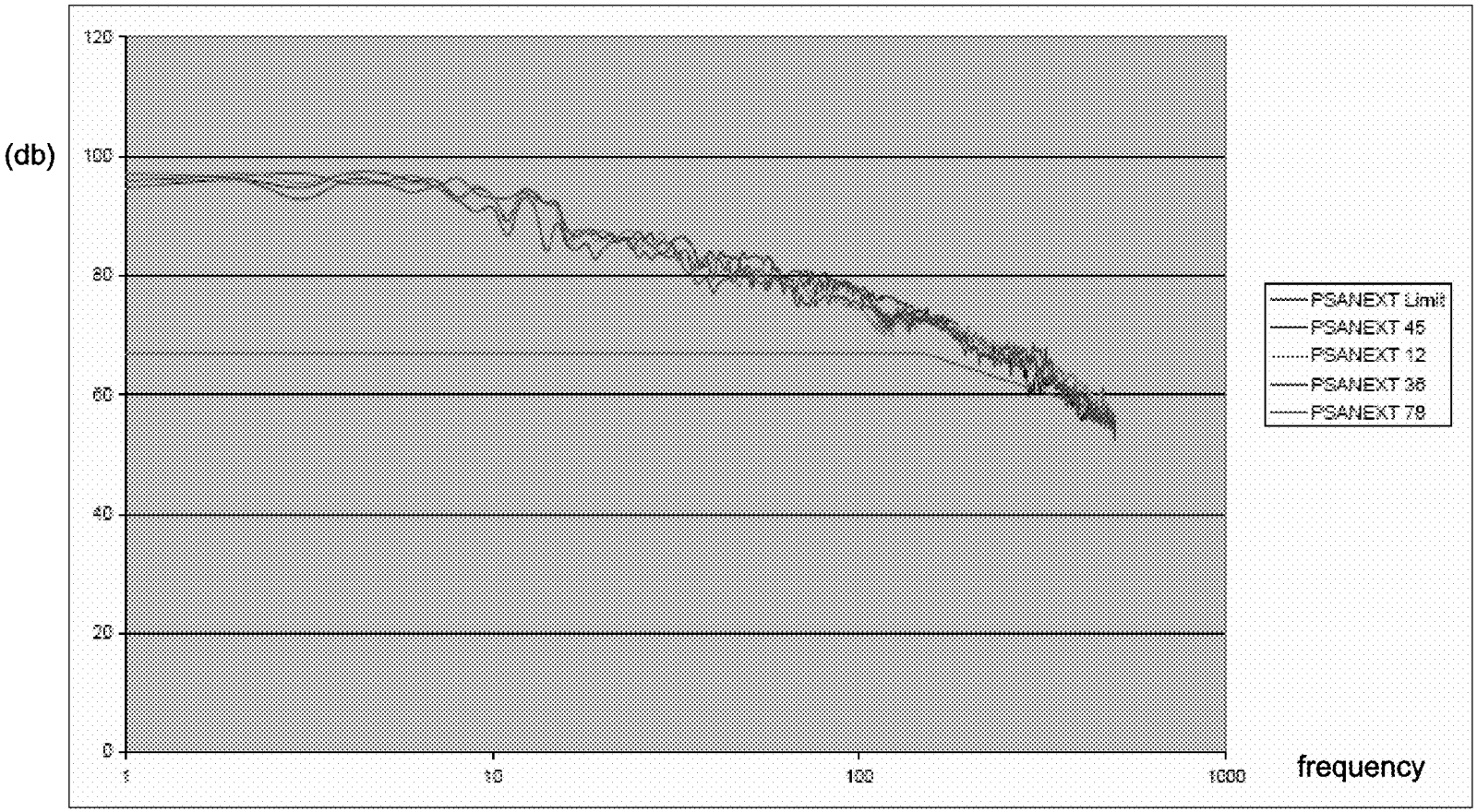
FIG. 4 is a crosstalk curve obtained from an equivalent electrical socket constructed according to the prior art without an electrically conductive material.

Further, FIG. 3 illustrates a crosstalk curve obtained from the aforesaid alien crosstalk preventive electrical socket, and FIG. 4 illustrates a crosstalk curve obtained from a conventional equivalent electrical socket. As shown in FIG. 3, the crosstalk is greatly reduced, or about 10 db at 100 MHz. As shown in FIG. 4, the electrical socket, in which the body, upper back cover, lower back cover and IDC housing are simply made of a plastic material without containing any electrically conductive material, fails at the high frequency range. Therefore, the invention effectively reduces alien crosstalk.

Figure 5:
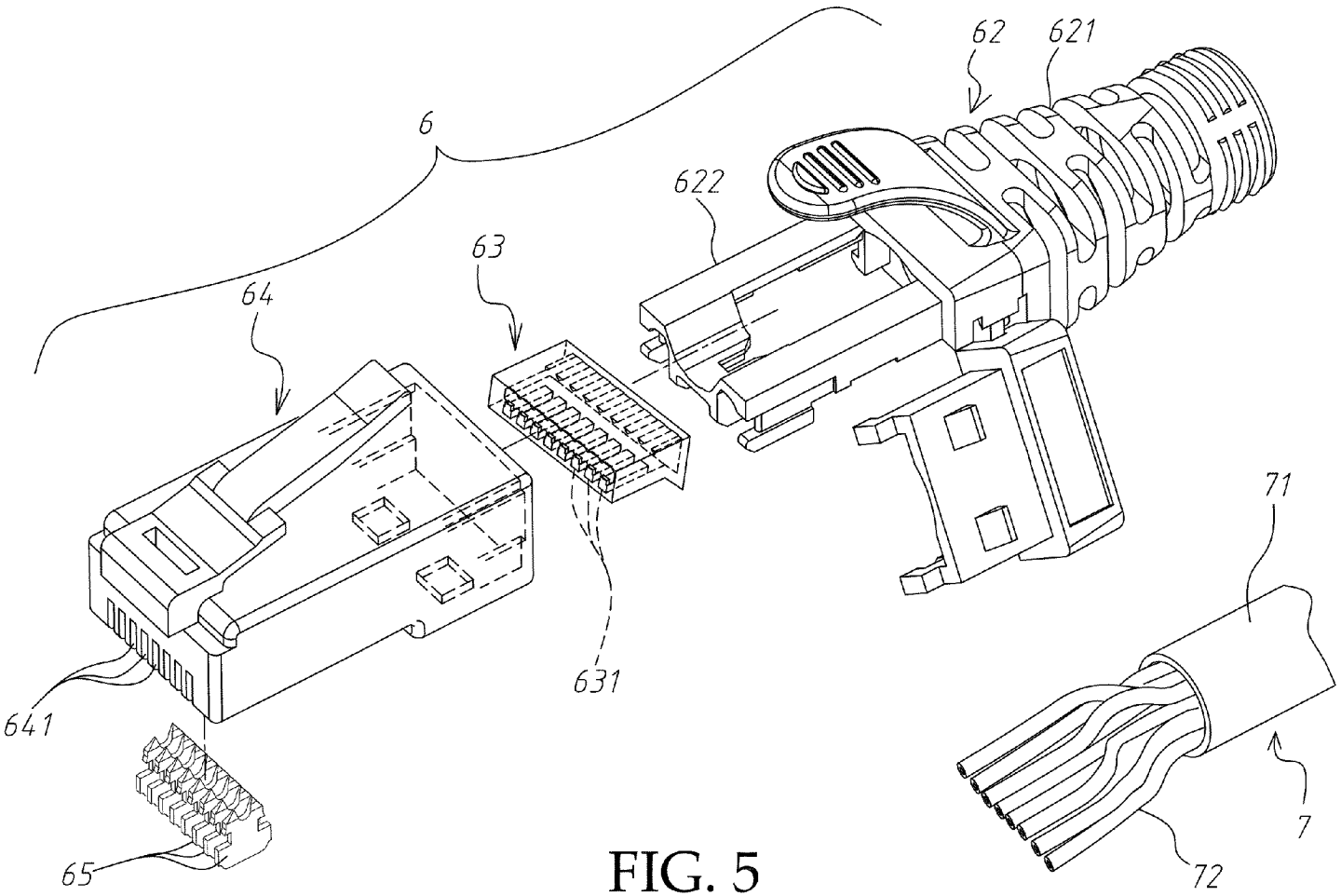
FIG. 5 is an exploded view of an alien crosstalk preventive electrical plug and an alien crosstalk preventive network cable constructed in accordance with the present invention.
Figure 6:
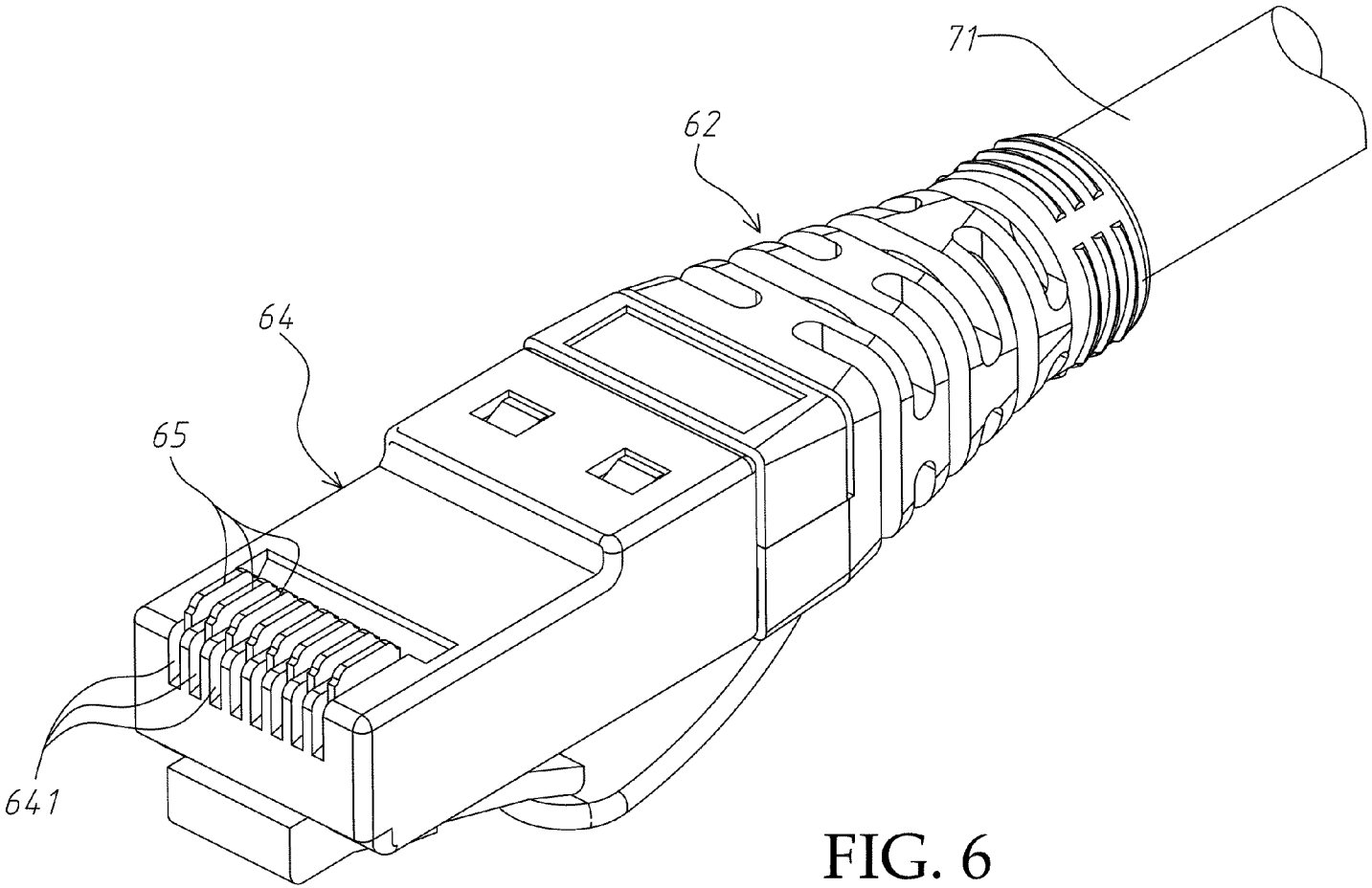
FIG. 6 is an elevational assembly view of the alien crosstalk preventive electrical plug and alien crosstalk preventive network cable shown in FIG. 5.

Referring to FIGS. 5 and 6, the aforesaid electrically conductive plastic complex material can be used in the fabrication of an alien crosstalk preventive electrical plug 6 or alien crosstalk preventive network cable 7.

As illustrated, the alien crosstalk preventive electrical plug 6 comprises an insulative jacket 62, a rack 63, a plug body 64 and 8 conducting plates 65. The network cable 7 comprises a cylindrical outer insulation 71 and four twisted pairs of electrical wires 72.

The insulative jacket 62 comprises a base 621 that surrounds one end of the cylindrical outer insulation 71, and a locating block 622 forwardly extended from the base 621 and adapted to stop the cylindrical outer insulation 71 in position.

The rack 63 is mounted at the front side of the locating block 622 of the insulative jacket 62, having 8 holes 631 arranged in a row for the passing of the electrical wires 72 of the network cable 7 individually.

The plug body 64 is mounted around the locating block 622 of the insulative jacket 62 and surrounding the rack 63, having 8 wire slots 641 arranged in a row and extending backwardly upwards from the front bottom side thereof for accommodating the electrical wires 72 of the network cable 7 individually.

The 8 conducting plates 65 are respectively mounted in the 8 wire slots 641 of the plug body 64 and respectively engaged with the respective pointed tips thereof into the insulations of the electrical wires 72 to make a respective electrical contact.

The insulative jacket 62, the rack 63, the plug body 64 and the cylindrical outer insulation 71 are respectively made of an electrically conductive plastic complex material prepared from a compound of a plastic material and an electrically conductive material. The electrically conductive plastic complex material has high dielectric index and low electrical resistivity characteristics, avoiding signal in and signal out and reducing alien crosstalk, and therefore effectively preventing EMI (electromagnetic interference) radiation.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. An alien crosstalk preventive electrical socket for connection with an alien crosstalk preventive cable, comprising:

a body having an insertion hole located on a front side thereof for the insertion of a matching electrical plug;

an upper back cover and a lower back cover respectively pivotally connected to rear upper side and rear bottom side of said body;

an IDC housing accommodated in said body, said IDC housing comprising a plurality of metal contacts positioned in said insertion hole of said body for the contact of matching contacts of an inserted electrical plug for data transmission; and a back cover fastened to said upper back cover and said lower back cover at a back;

wherein said body, said upper back cover, said lower back cover and said IDC housing are made of an electrically conductive plastic complex material prepared from a compound of a plastic material and an electrically conductive material, said electrically conductive plastic complex material having high dielectric index and low electrical resistivity characteristics to reduce alien crosstalk;

wherein said electrically conductive material is prepared in one of the forms of grains, powder and fibers, and then well mixed with said plastic material to form the desired electrically conductive plastic complex material and then processed through an injection fusion process to form the desired electrically conductive plastic complex material;

wherein said alien crosstalk preventive network cable comprising a cylindrical outer insulation and four twisted pairs of electrical wires surrounded by said cylindrical outer insulation, wherein said cylindrical outer insulation is made of an electrically conductive plastic complex material prepared from a compound of a plastic material and an electrically conductive material said electrically conductive plastic complex material having high dielectric index and low electrical resistivity characteristics to reduce alien crosstalk.

2. An alien crosstalk preventive electrical plug connected with a network cable having a cylindrical outer insulation and four twisted pairs of electrical wires surrounded by said cylindrical outer insulation, the alien crosstalk preventive electrical plug comprising:

an insulative jacket comprising a base surrounding one end of said cylindrical outer insulation of said network cable and a locating block forwardly extended from said base and adapted to stop said cylindrical outer insulation of said network able in position;

a rack mounted at a front side of said locating block of said insulative jacket, said rack comprising eight holes arranged in a row for the passing of the electrical wires of said network cable individually;

a plug body mounted around said locating block of said insulative jacket and surrounding said rack, said plug body comprising eight wire slots arranged in a row and extending backwardly upwards from a front bottom side thereof for accommodating said electrical wires of said network cable individually; and eight conducting plates respectively mounted in said eight wire slots of said plug body, each said conducting plate having a pointed tip engaged into one respective said electrical wire to make a respective electrical contact;

wherein said insulative jacket, said rack and said plug body are respectively made of an electrically conductive plastic complex material prepared from a compound of a plastic material and an electrically conductive material, said electrically conductive plastic complex material having high dielectric index and low electrical resistivity characteristics to reduce alien crosstalk;

wherein said electrically conductive material is prepared in one of the forms of grains, powder and fibers, and then well mixed with said plastic material to form the desired electrically conductive plastic complex material and then processed through an injection fusion process to form the desired electrically conductive plastic complex material;

wherein said alien crosstalk preventive network cable comprising a cylindrical outer insulation and four twisted pairs of electrical wires surrounded by said cylindrical outer insulation, wherein said cylindrical outer insulation is made of an electrically conductive plastic complex material prepared from a compound of a plastic material and an electrically conductive material said electrically conductive plastic complex material having high dielectric index and low electrical resistivity characteristics to reduce alien crosstalk.

* * * * *